US007891118B2

(12) United States Patent
Chen et al.

(10) Patent No.: US 7,891,118 B2
(45) Date of Patent: Feb. 22, 2011

(54) SPIKE ASSEMBLY FOR SPORT SHOES

(76) Inventors: Kuming Chen, No. 17. Lane 51, Anhe Rd., Tanzih Township 427, Taichung County (TW); Hsien Ping Chen, No. 17, Lane 51, Anhe Rd., Tanzih Township 427, Taichung County (TW)

( * ) Notice: Subject to any disclaimer, the term of this patent is extended or adjusted under 35 U.S.C. 154(b) by 606 days.

(21) Appl. No.: 12/034,697

(22) Filed: Feb. 21, 2008

(65) Prior Publication Data

US 2009/0211116 A1 Aug. 27, 2009

(51) Int. Cl.
*A43B 5/00* (2006.01)

(52) U.S. Cl. ..... 36/67 D; 36/134

(58) Field of Classification Search ..... 36/67 R, 36/67 D, 134

See application file for complete search history.

(56) References Cited

U.S. PATENT DOCUMENTS 5,123,184 A * 6/1992 Ferreira ..... 361/34
5,321,901 A * 6/1994 Kelly ..... 36/134
5,524,367 A * 6/1996 Ferreira et al. ..... 36/134
5,974,700 A * 11/1999 Kelly ..... 36/134
6,233,850 B1 * 5/2001 Peabody ..... 36/134
6,708,428 B2 * 3/2004 Chen ..... 36/134
6,810,608 B2 * 11/2004 Kelly ..... 36/134
6,834,445 B2 * 12/2004 McMullin ..... 36/127
7,007,413 B2 * 3/2006 McMullin ..... 36/134
7,137,213 B2 * 11/2006 Kelly et al. ..... 36/134
2002/0152643 A1 * 10/2002 Kim ..... 36/127

* cited by examiner

*Primary Examiner*—Marie Patterson

(57) ABSTRACT

A spike assembly is engaged with a recess in the outsole of a sport shoe and includes a base with a tubular portion and a plurality of protrusions extend from the base portion in axial direction of the base portion. Each protrusion includes an inclined side and a vertical side with a rounded portion connecting between the inclined side and the vertical side. A spike member includes screw portion which is securely connected to the tubular portion and an annular portion extends from the spike member, a plurality of blocks extend from the top of the annular potion which has a tapered outer periphery so as to seal the recess of the outsole of the sport shoe. The blocks slide along the inclined sides of the protrusions and then stopped by the vertical sides of the protrusions.

4 Claims, 8 Drawing Sheets

SPIKE ASSEMBLY FOR SPORT SHOES

FIELD OF THE INVENTION

The present invention relates to a spike assembly for sport shoes and includes a base and a spike member which is easily and securely connected to the base and seals the recess in the outsole of the sport shoe.

BACKGROUND OF THE INVENTION

Conventional sport shoes such as golf shoes, soccer shoes or baseball shoes require good grasp to the ground so that spikes extend from an underside of the outsole and the spikes cut into the ground to provide reliable grasp. A conventional spike assembly is shown in FIGS. 6, 7, 7A and 8, and generally includes a base 32 which is embedded in a recess 21 defined in the underside of the outsole 20 of the shoe, and a spike member 33 is connected to the base 32. The base 32 includes a disk 321 with a tubular portion 322 extending from a center thereof and a spiral groove 323 is defined in an inner periphery of the tubular portion 322. A plurality of protrusions 324 extend radially from the outer periphery of the tubular portion 322. The protrusions 324 form recesses 3241 and peaks which are located between the recesses 3241, and each peak includes two inclined sides 3242 on two sides thereof.

The spike member 33 includes a disk 331 and a screw potion 332 extends from a center of the first side of the disk 331. A plurality of blocks 333 extend from the disk 33 and located around the screw portion 332. Each block 333 includes a curved protrusion 334 extending therefrom which faces the screw potion 332. Spikes 335 extend from the second side of the disk 332.

When screwing the screw portion 332 with the spiral groove 323 of the tubular portion 322, the curved protrusions 334 are stopped by the protrusions 324 on the base 32 so that the user has to use a tool to rotate the spike member 33 to press the protrusions 324 outward and radially to allow the curved protrusions 324 to slide along the inclined sides 3242 and to be engaged with the recesses 3241 between the peaks of the protrusions 324.

When the wearer wears the shoes, a load applies the spike assembly and the blocks 333 are pushed outward in the radial direction and the curved protrusions 324 may be guided by the inclined sides 3242 of the protrusions 324 and the spike member 33 can be easily loosened from the base 32. Besides, there will be a gap between the inner periphery of the recesses 21 in the outsole 20 so that dirt, earth and pebbles are easily trapped in the gap. Once the dirt and the earth are dried, they are difficult to be removed from the gap and this makes the replacement of the spike assembly to be more difficult.

The present invention intends to provide a spike assembly for sport shoes and the spike member can be securely connected to the base and the wearer's weight does not affect the connection between the spike member and the base.

Furthermore, the spike member includes a tapered annular portion which seals the recess in the outsole of the sport shoe to avoid the dirt, earth and pebble from entering the recess of the outsole.

SUMMARY OF THE INVENTION

The present invention relates to a combination of spike assembly and sport shoe, wherein the spike assembly comprises a base including a first disk and a tubular portion extends from a center of a first side of the first disk. The first disk is engaged with a recess in the outside of the sport shoe. A spiral groove is defined in an inner periphery of the tubular portion. A plurality of protrusions extend axially from the first side of the first disk and are connected to an outer periphery of the tubular portion. Each protrusion is a substantially triangular protrusion and includes an inclined side relative to the first side of the first disk and a vertical side perpendicular to the first side of the first disk. A rounded portion connects between the inclined side and the vertical side.

A spike member includes a second disk and a screw potion extends from a center of a first side of the second disk. A plurality of spikes extend from a second side of the second disk. An annular portion extends from the first side of the second disk and includes a tapered outer periphery. The annular portion is located around the screw portion and a plurality of blocks extend from a top of the annular portion at equal intervals.

The screw portion is engaged with the spiral groove in the tubular portion and the blocks slide along the inclined sides of the protrusions and move over the rounded portions and are stopped by the vertical sides. The tapered outer periphery of the annular portion seals the recess in the outsole of the sport shoe.

The primary object of the present invention is to provide a spike assembly for sport shoes, wherein the spike member is securely connected to the base by engaging the blocks on the annular portion on the spike member with the vertical sides of the protrusions on the base in axial direction. The blocks do not disengage from the protrusion when the wearer's weight applies to the spike assembly.

Another embodiment of the present invention is to provide a spike assembly for sport shoes wherein the recesses of the outsole of the sport shoe are sealed by the annular portion of the spike members of the spike assemblies.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
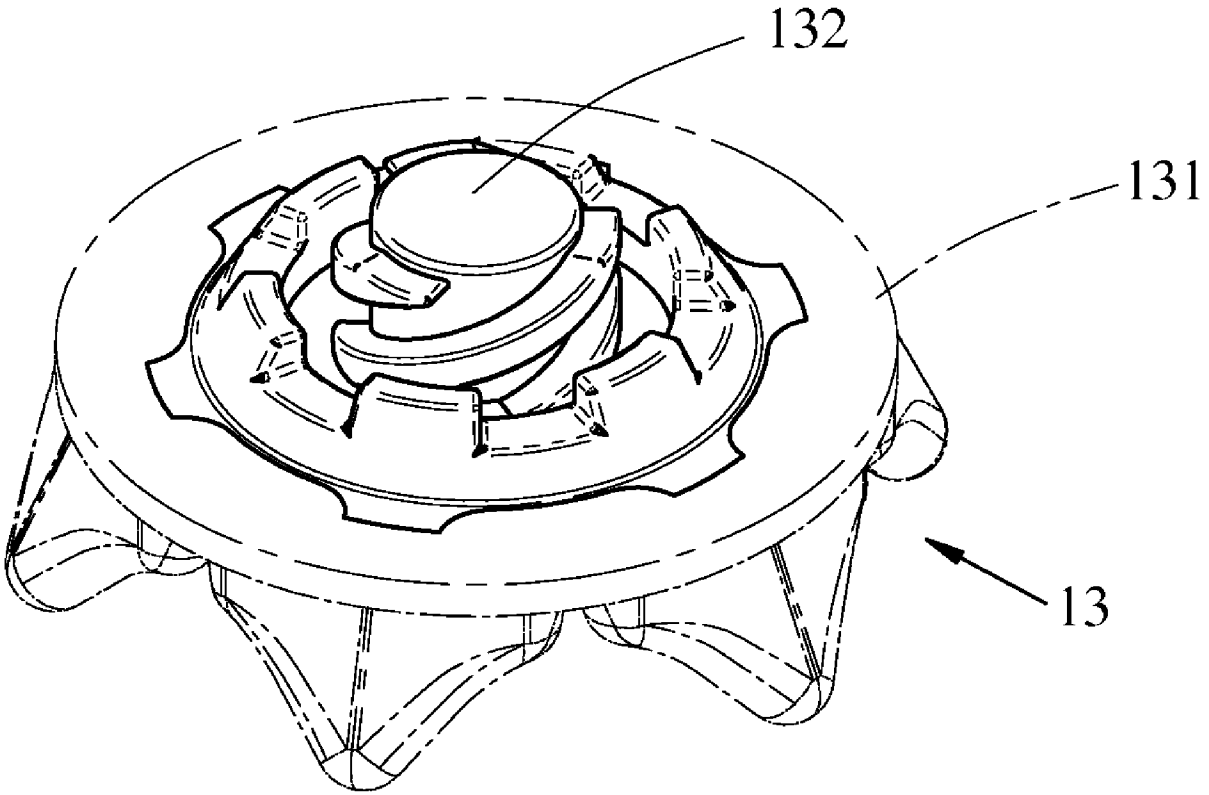
FIG. 1 is a perspective view to show the base of the spike assembly of the present invention.

Referring to FIGS. 1, 2, 3 and 3A, the spike assembly for sport shoes of the present invention comprises a base 12 including a first disk 121 and a tubular portion 122 extends from a center of a first side of the first disk 121. The first disk 121 is engaged with a recess 21 defined in an outside 20 of the sport shoe. A spiral groove 123 is defined in an inner periphery of the tubular portion 122 and a plurality of protrusions 124 extend axially from the first side of the first disk 121 and are connected to an outer periphery of the tubular portion 122. Each protrusion 124 is a substantially triangular protrusion and includes an inclined side 1241 relative to the first side of the first disk 121 and a vertical side 1242 perpendicular to the first side of the first disk 121. A rounded portion connects between the inclined side 1241 and the vertical side 1242.

A spike member 13 includes a second disk 131 and a screw potion 134 extends from a center of a first side of the second disk 131. A plurality of spikes 135 extend from a second side of the second disk 131 and each of the spikes 135 is a substantially triangular spike. Reinforcement ribs 136 are connected between the second side of the second disk 131 and the spikes 135. An annular portion 133 extends from the first side of the second disk 131 and includes a tapered outer periphery 1331. The annular portion 133 located around the screw portion 132. A plurality of blocks 134 extend from a top of the annular portion 133 at equal intervals.

Figure 5A:
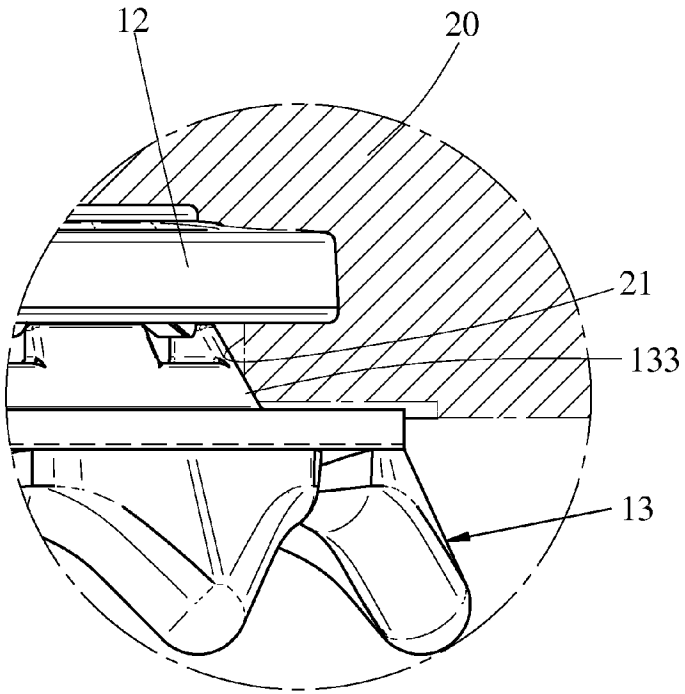
FIG. 5A is an enlarged view to show that the recess of the outsole is sealed by the annular portion of the spike member.
Figure 5:
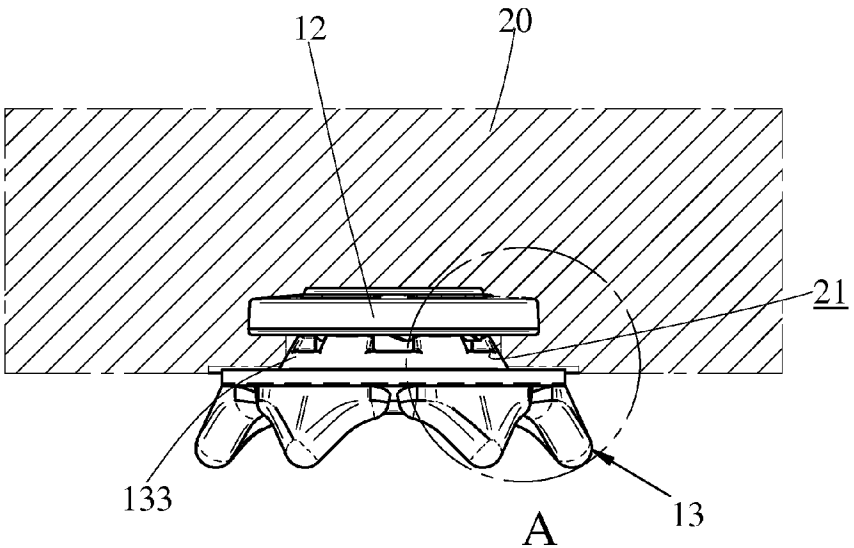
FIG. 5 is a side view to show that the spike assembly of the present invention is engaged with the recess in the outsole of a sport shoe.
Figure 6:
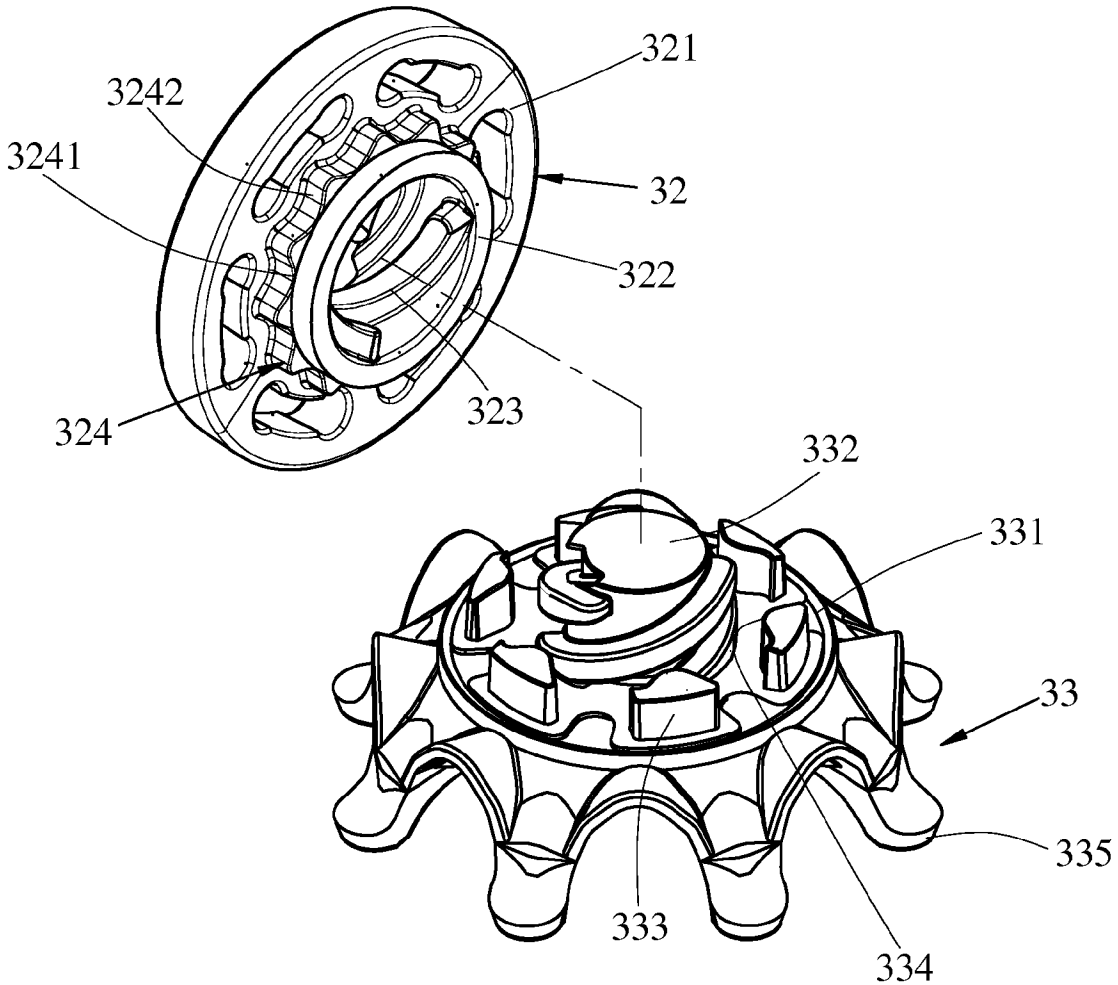
FIG. 6 PRIOR ART
FIG. 6 is an exploded view to show the conventional spike assembly.
Figure 7A:
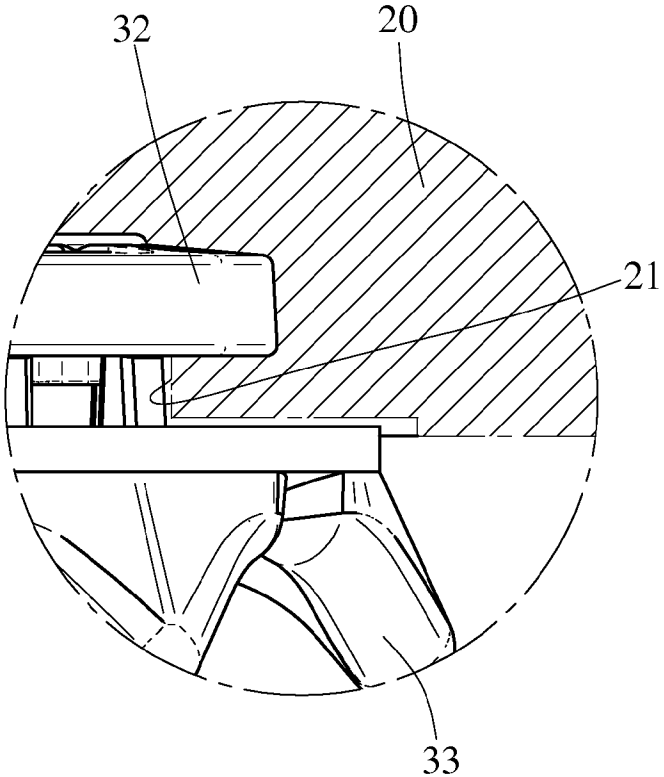
FIG. 7A PRIOR ART
FIG. 7A is an enlarged view to show the circled portion in FIG. 7.
Figure 7:
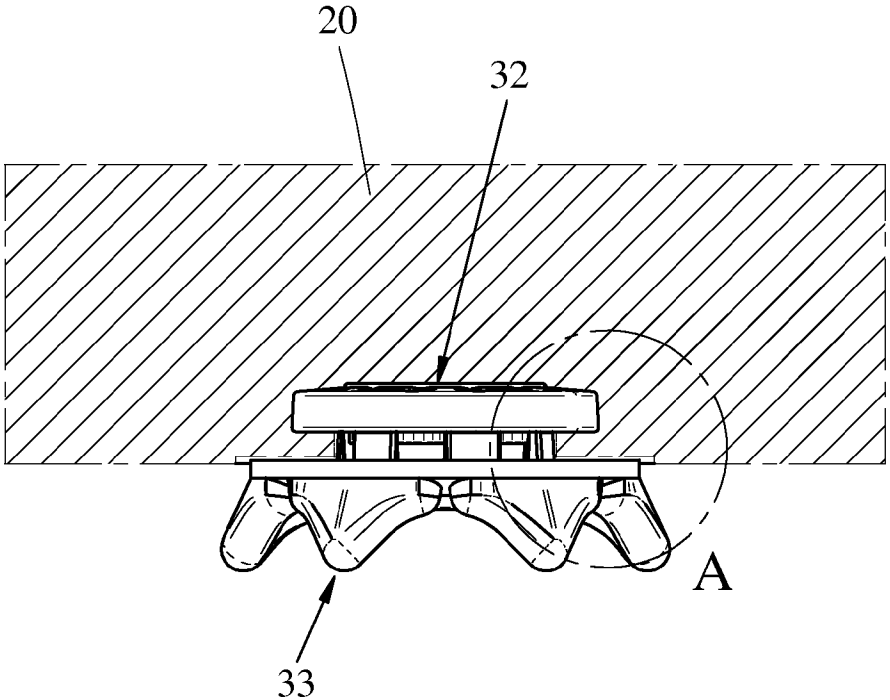
FIG. 7 PRIOR ART
FIG. 7 is side view to show that the conventional spike assembly is connected to the outsole of the sport shoe.
Figure 8:
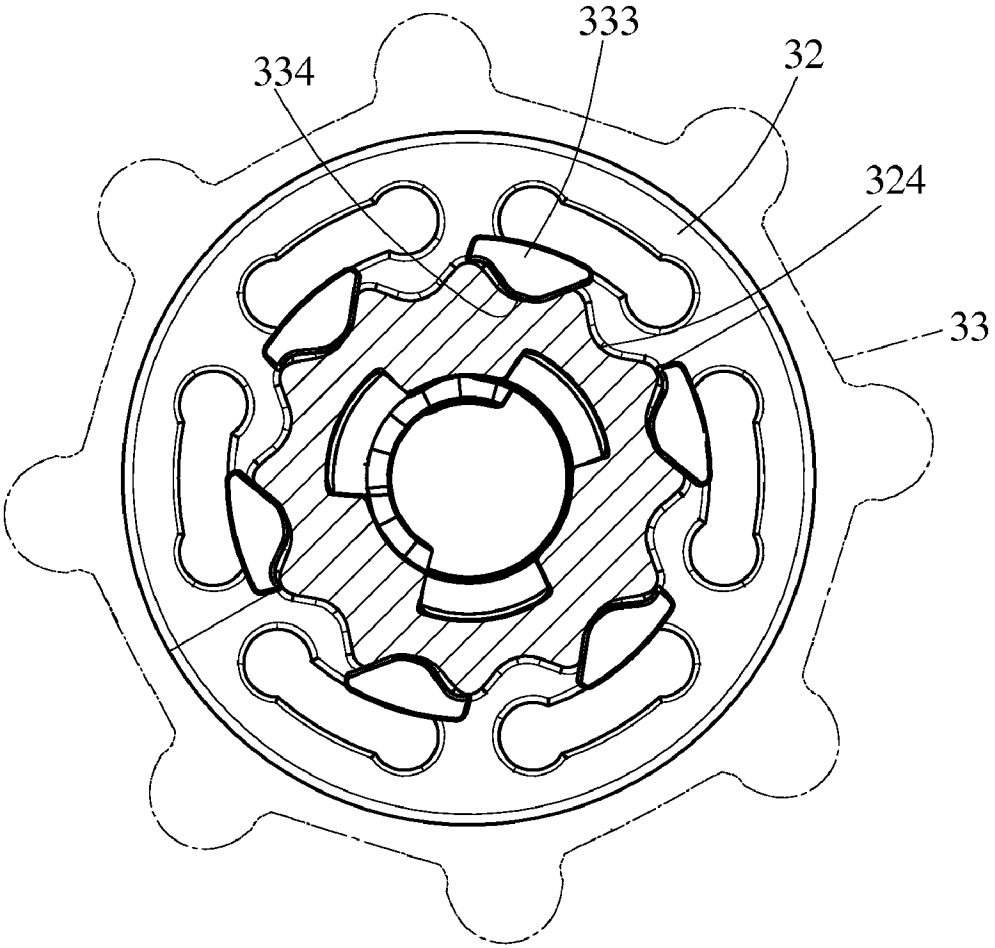
FIG. 8 PRIOR ART
FIG. 8 is a cross sectional view to show the engagement of the blocks and the recesses between protrusions on the tubular portion of the base of the conventional spike assembly.

When assembling the spike member 13 to the base 12, the screw portion 132 is engaged with the spiral groove 123 in the tubular portion 122 and the blocks 134 slide along the inclined sides 1241 of the protrusions 124 and move over the rounded portions and are stopped by the vertical sides 1242. The tapered outer periphery 1331 of the annular portion 133 seals the recess 21 in the outsole 20 of the sport shoe as shown in FIGS. 5 and 5A.

Figure 2:
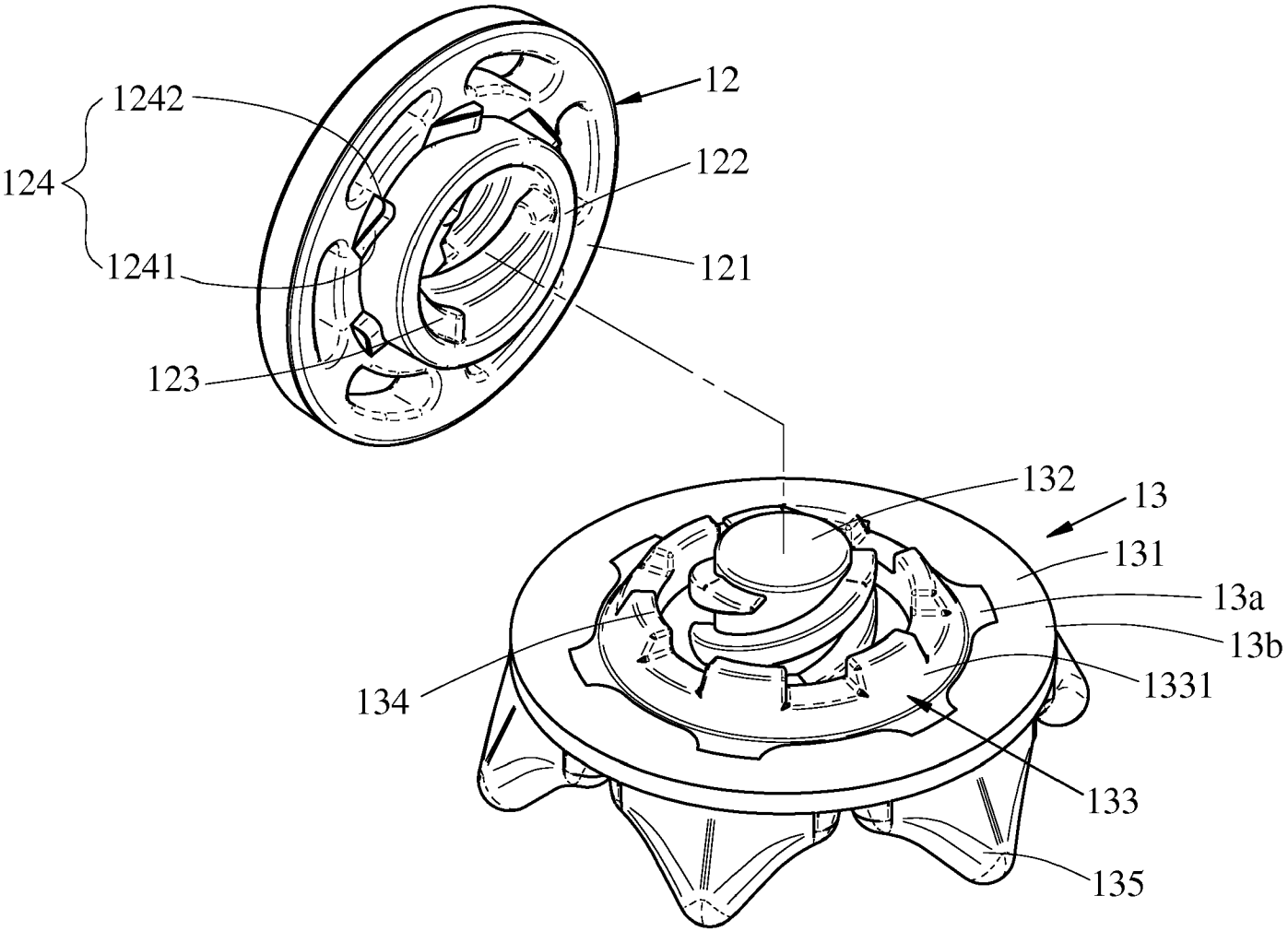
FIG. 2 is an exploded view to show the spike assembly of the present invention.
Figure 3A:
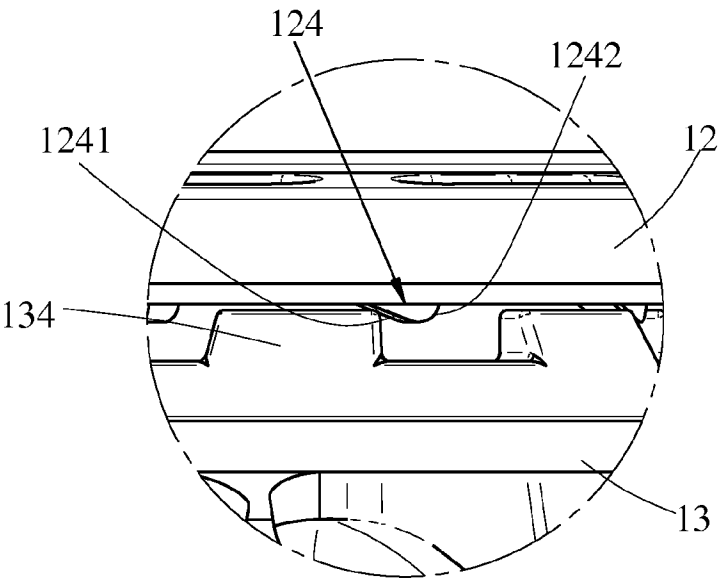
FIG. 3A is an enlarged view to show the circled portion in FIG. 3.
Figure 3:
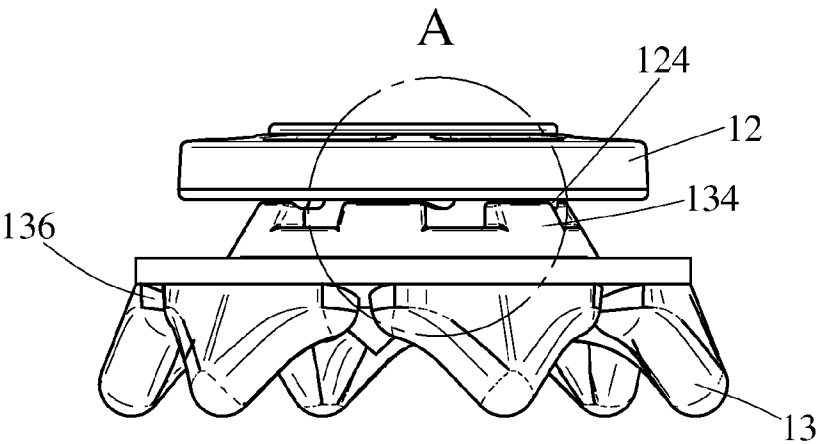
FIG. 3 is a side view to show the spike assembly of the present invention.

The spike member 13 includes a first part 13*a* and a second part 13*b* as shown in FIG. 2, wherein the first part 13*a* includes the screw portion 132, the annular portion 133 and the blocks 134, the first part 13*a* is made by hard material. The second part 13*b* is made by soft material and coated on the second disk 131 and the spikes 135.

Figure 4A:
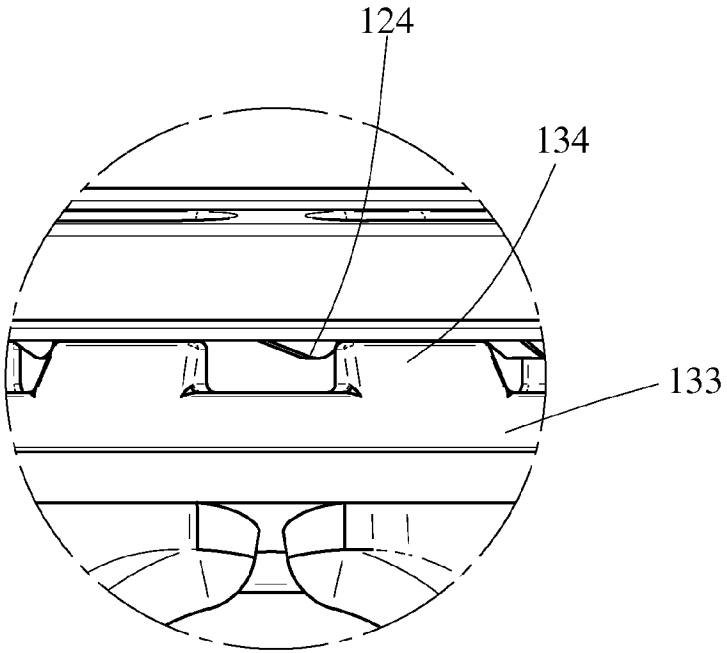
FIG. 4A is an enlarged view to show the circled portion in FIG. 4.
Figure 4:
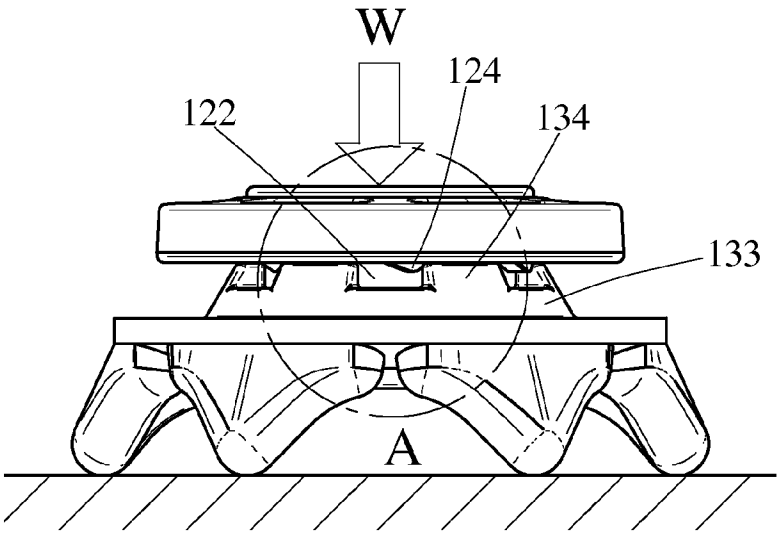
FIG. 4 is a side view to show that a load is applied to the spike assembly of the present invention.

As shown in FIGS. 4 and 4A, when a load such as the wearer's weight W is applied to the spike assembly, the blocks 134 together with the annular portion 133 are not deformed or expanded outward because the annular portion 133 is a complete circle so that the blocks 134 are not disengaged from the protrusions 124. Even if the blocks 134 are slightly expanded outward, the blocks 134 do not slide away from the vertical sides 1242 of the protrusions 124. Besides, the tapered outer periphery 1331 of the annular portion 133 seals the recess 21 of the outsole 20 to prevent foreign objects such as earth and pebbles from entering the gap between the inner periphery of the recess 21 and the spike assembly.

While we have shown and described the embodiment in accordance with the present invention, it should be clear to those skilled in the art that further embodiments may be made without departing from the scope of the present invention.

What is claimed is:

1. A combination of spike assembly and sport shoe, comprising:

a base including a first disk and a tubular portion extending from a center of a first side of the first disk, the first disk engaged with a recess defined in an outside of the sport shoe, a spiral groove defined in an inner periphery of the tubular portion, a plurality of protrusions extending axially from the first side of the first disk and connected to an outer periphery of the tubular portion, each protrusion being a substantially triangular protrusion and including an inclined side relative to the first side of the first disk and a vertical side perpendicular to the first side of the first disk, a rounded portion connecting between the inclined side and the vertical side, and a spike member including a second disk and a screw potion extending from a center of a first side of the second disk, an annular portion which extends from the first side of the second disk and including a tapered outer periphery, the annular portion located around the screw portion, a plurality of blocks extending from a top of the annular portion at equal intervals, the screw portion engaged with the spiral groove in the tubular portion and the blocks sliding along the inclined sides of the protrusions and moving over the rounded portions and stopped by the vertical sides, the tapered outer periphery of the annular portion sealing the recess in the outsole of the sport shoe, a plurality of spikes extending from a second side of the second disk.

2. The spike assembly as claimed in claim 1, wherein the spikes each are a substantially triangular spike.

3. The spike assembly as claimed in claim 2, wherein reinforcement ribs are connected between the second side of the second disk and the spikes.

4. The spike assembly as claimed in claim 1, wherein the spike member includes a first part which includes the screw portion, the annular portion and the blocks, the first part is made by hard material, a second part is made by soft material and coated on the second disk and the spikes.

* * * * *